US005341524A

United States Patent [19]

Zellner

[11] Patent Number: 5,341,524

[45] Date of Patent: Aug. 30, 1994

[54] ROLL-IN BATH TUB

[76] Inventor: Robert J. Zellner, 648 Highview Ter., Lake Forest, Ill. 60045

[21] Appl. No.: 58,378

[22] Filed: May 10, 1993

[51] Int. Cl.[5] ..... A47K 3/022

[52] U.S. Cl. ..... 4/555; 4/604

[58] Field of Search ..... 4/555, 556, 604, 559, 4/560.1

[56] References Cited

U.S. PATENT DOCUMENTS

| | | | |
|---|---|---|---|
| 2,075,933 | 4/1937 | Friedlander | 4/556 |
| 4,757,561 | 7/1988 | Crump | 4/604 |
| 4,890,341 | 1/1990 | Forbes | 4/555 |
| 5,136,735 | 8/1992 | Zimmerman | 4/604 X |
| 5,184,358 | 2/1993 | Gruidel et al. | 4/555 |

OTHER PUBLICATIONS

Aqua Glass, "Special Care", sales brochure, 1983.

*Primary Examiner*—Robert M. Fetzuga

[57] ABSTRACT

This disclosure relates to an accessory to a bathing system, e.g., a bathtub with a step-through access, to provide a bather of restricted mobility roll-in capability to shower. It features a ramp i.e., an inclined surface, which in this invention is fixed in position to furnish roll-in access to the tub. Associated devices cooperate to locate and secure the ramp in the access, More specifically, an insert having opposed legs and a base engages grooves on the sides of the access. In one embodiment, a splash shield extends upright from the ramp to divert shower water back into the tub.

6 Claims, 1 Drawing Sheet

ROLL-IN BATH TUB

FIELD OF THE INVENTION

This invention relates to the field of bathing systems, especially to bathtubs which are adaptable to the changing demands of those who have increasing needs for easy access to bathing facilities.

BACKGROUND OF THE INVENTION

It is generally recognized that there is an increasing proportion of senior citizens in the general population. Major concerns of these seniors include the selection of a retirement residence for independent living, and within that residence, the choice of bathing facilities that can be adapted to the changing needs of the senior, so that the resident may continue to occupy the dwelling unit as long as possible before being required by physical limitations to move to an extended care facility.

Bathtubs and shower enclosures designed to address the changing needs of seniors are shown in U.S. Pat. Nos. 4,996,729 and 5,090,068 but these bathing systems are not convertable from a bath to a step-in shower and do not provide roll-in access for a wheeled shower chair. The bathing tub of U.S. Pat. No. 5,184,358 also addresses this need.

BRIEF SUMMARY OF THE INVENTION

The instant invention resides in a bathing system comprising a bathing chamber with roll-in access via a ramp. In one embodiment the chamber is a bathtub having a passage which can be closed with a removable dam for conventional tub bathing. To use the fixture as a shower, the dam can be removed for step-in access or the dam can be exchanged for a ramp to enable roll-in access through the passage. The ramp may also carry a diverter to direct water splashes into the tub.

More particularly, the bathing system of this invention comprises a bathtub defined by opposed ends, a back wall, a front wall and a bottom which is above the bath room floor. In the front wall is a passage defined by upper sides and a lower side at about the level of the tub bottom. The passage accepts an insert having arms which match the contours of the passage and are joined at their lower ends by a base. Locating means are supplied to position the insert in the passage, and securing means retain the insert in the passage. A ramp on the base of the insert enables a bather in a shower chair to roll from the floor of the bath room on to the bottom of the tub. In one embodiment the locating means includes a groove in the lower side of the passage. In another embodiment the locating means includes a groove in an upper side of the passage. In a preferred embodiment a diverter, positioned to direct splashes of the bath water to the interior of the tub, is located between the arms of the insert along with means to position the diverter in an upright position.

The invention will be more fully understood from the following drawings and detailed description.

THE DRAWINGS

DETAILED DESCRIPTION OF THE INVENTION

Figure 1:
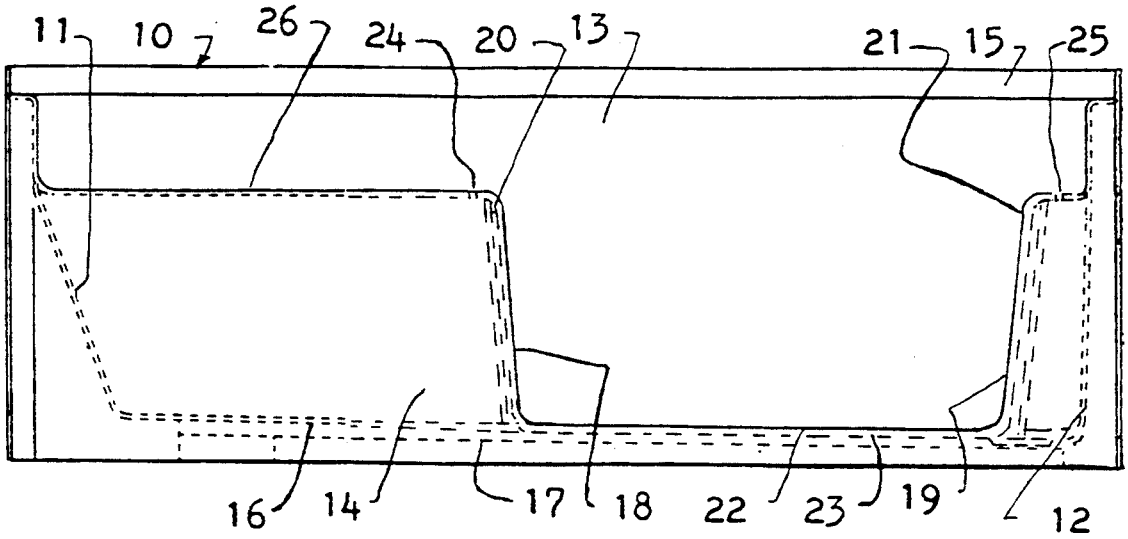
FIG. 1 shows a side view of a bathtub having a passage through its front wall.

Referring to FIG. 1, there is shown generally a bathtub 10 having opposed ends 11 and 12, a back wall 13, a front wall 14, and a bottom 16. The tub may be made of gel coat fiberglass or other suitable material. The bottom desirably has a non-slip surface and is stiffened with reinforcement 17 to meet NAHB standards for deflection. The top rim of the tub has a recess 15 to accept a surround such as that shown in U.S. Pat. No. 5,090,068 or a custom built tile enclosure. A passage through the front wall is defined by upper sides 18 and 19 which diverge at their upper ends by about five degrees from the vertical and by a lower side 22 which is about even with the bottom 16 of the tub. In one embodiment the sides may have grooves 20 and 21 and the lower side may have a groove 22. These grooves may be about one inch wide by one half inch deep but these dimensions are not critical. In some embodiments either the side grooves or the lower groove may be eliminated although all are shown in FIG. 1 and are preferred. Fasteners are located in the tub at 24 and 25. The fastener may be a recessed nut to hold a screw or a stud to receive a slide or snap fastener of conventional design. The bottom of the tub normally will be about one and one half or two inches above the floor of the bath room so that access to the tub by a rolling bath chair will be difficult without the insert described below.

Figure 2:
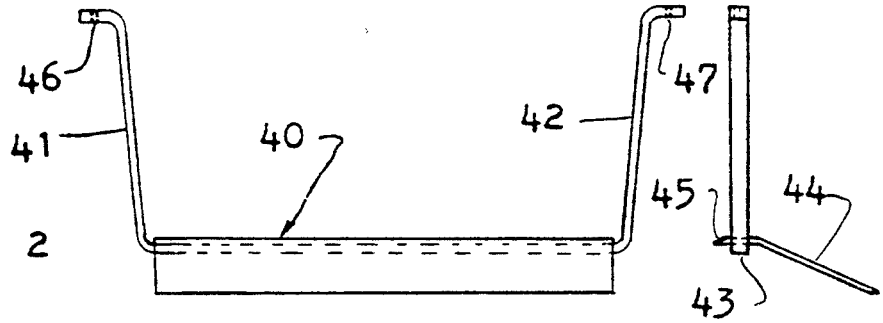
FIG. 2 shows one form of insert which matches the contours of the passage.

FIG. 2 shows an insert 40 constructed of aluminum, stainless steel or a suitable engineering plastic and having arms 41 and 42 and a base 43 with dimensions and a configuration to mate with the sides of the passage through the front wall of the tub and the grooves 20, 21, and 23 when the grooves are provided. A ramp 44 is suitably secured to the base by welding, with adhesive or with mechanical fasteners. The inner edge 45 of the ramp is beveled. The ramp has a slope of about one in twelve or about five degrees to comply with current accessability standards and a length to reach the bathroom floor; a ramp with a different slope may be installed, for example, to meet modified standards, if any. The insert is held in operative position in the passage of the tub by securing means such as fasteners inserted in holes 46 and 47 which mate with those in locations 24 and 25. The mating of the arms in the grooves maintains the insert in correct position. For some installations it may be desirable to employ only the upper side grooves 20 and 21 as they are adequate to position the insert. Alternatively, only the lower side groove 23 may be employed and the upper side grooves omitted.

Figure 3:
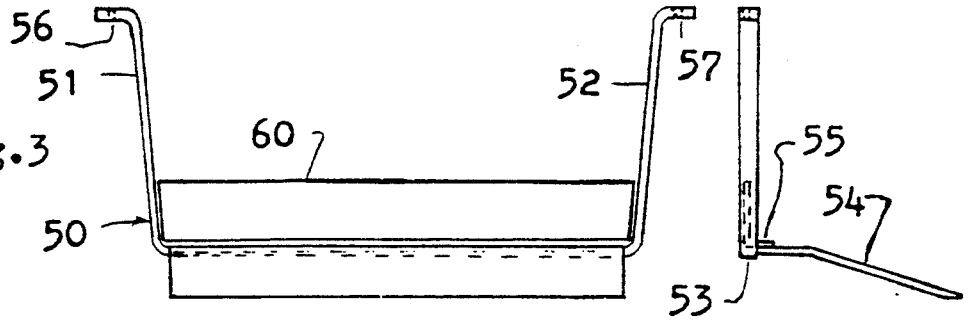
FIG. 3 shows another from of insert which matches the contours of the passage.

FIG. 3 shows an insert 50 of another construction wherein the ramp 54 is fastened to the edge of the base 53 rather than above it as shown for ramp 44 of FIG. 2. Arms 51 and 52 mate with the sides of the passage of the tub or with the grooves 20 and 21. If the side grooves are eliminated and the insert is located only with the lower groove 23 the arms mate with the surfaces of the upper sides 18 and 19. Fasteners through the holes 56 and 57 secure the insert in position.

Also shown in FIG. 3 is a diverter 60 which is made of a flexible material such as rubber or from a self hinging material such as polypropylene. If of rubber the diverter is attached to the ramp at 55 as with an adhesive such as Scotchgrip 1300. The diverter may also be made of metal and hinged to the base 53 for movement in either direction, into or out of the tub, so that it offers minimal resistance to the passage of a rolling shower chair. If made from rubber the construction may be such that the diverter is self-erecting to the position shown in FIG. 3 after having been deflected by the wheels of a shower chair, for example, while in transit through the passage. In other constructions, the diverter may be positioned manually and secured in the upright position with holding means such as a detent on an arm 51 or 52 or both. Bias means such as a spring may urge the diverter to the upright position while nevertheless permitting the diverter to be deflected by the wheels of the shower chair during its traverse through the passage. In its upright position, the diverter cooperates with the shower curtain (not shown) to direct most of the errant shower water into the tub.

Of course a solid panel (not shown) may be inserted in the passage and sealed to the tub wall with a gasket of sponge rubber, for example, to configure the tub as a conventional full bath if that is desired. To convert such a tub to a roll-in shower, it is merely necessary to exchange the solid panel with an insert of FIG. 2 or FIG. 3. To convert back to a full bath is equally easy by reinstalling the solid panel. This versatility is attractive to a resident who may desire to change his bathing option without the trouble and expense of installing an entirely new tub or roll-in shower. The adaptability is also of great interest to the builder or operator of a retirement residence development.

The embodiments described above and illustrated in the drawings are, of course, to be regarded as non-limiting examples and as to their details may be modified in several ways within the scope of the following claims.

What is claimed is:

1. In a bathing system comprising a bathtub defined by opposed ends, a back wall, a front wall and a bottom, and having in said front wall a passage defined by upper sides and a lower side, said lower side being about at the level of the tub bottom, an insert comprising a ramp adjacent the front wall of the tub with its upper end adjacent said lower side and a length sufficient to reach the bathroom floor, locating means cooperating with the upper sides of the passage to position the ramp between said upper sides, securing means to retain the ramp between the sides of the passage, a deflectable, upright diverter on the ramp, and biasing means to position the diverter in the upright position, whereby a bather in a bath chair may easily roll from the floor of the bathroom to the bottom of the tub and splashes of bath water can be directed to the interior of the tub when the diverter is in the upright position.

2. A bathing system as defined in claim 1 wherein the locating means comprises opposed arms having upper and lower ends, said arms configured to mate with the upper sides of the passage, and a base joining the arms at their lower ends, and wherein the ramp is attached to the base of the insert.

3. A bathing system as defined in claim 2 wherein the locating means includes a groove in the upper sides of the passage to receive the arms of the insert.

4. The bathing system as defined in claim 1 wherein the diverter is between the arms of the insert.

5. In a bathing system comprising a bathtub defined by opposed ends, a back wall, a front wall and a bottom, and having in said front wall a passage defined by upper sides and a lower side, said lower side being about at the level of the tub bottom, an insert comprising a ramp adjacent the front wall of the tub with its upper end adjacent said lower side and a length sufficient to reach the bathroom floor, locating means cooperating with the upper sides of the passage to position the ramp between said upper sides, and securing means to retain the ramp between the sides of the passage, said locating means comprising opposed arms having upper and lower ends, said arms configured to mate with the upper sides of the passage, a base member joining the arms at their lower ends, a groove in the lower side of the passage to receive the base member of the insert, and wherein the ramp is attached to the base of the insert, whereby a bather in a bath chair may easily roll from the floor of the bathroom to the bottom of the tub.

6. In a bathing system comprising a bathtub defined by opposed ends, a back wall, a front wall and a bottom, and having in said front wall a passage defined by upper sides and a lower side, said lower side being about at the level of the tub bottom, an insert comprising a ramp adjacent the front wall of the tub with its upper end adjacent said lower side and a length sufficient to reach the bathroom floor, locating means cooperating with the upper sides of the passage to position the ramp between said upper sides, and securing means to retain the ramp between the sides of the passage, said locating means comprising a groove in each upper side of the passage, opposed arms having upper and lower ends, said arms configured to mate with the grooves in the upper sides of the passage, a base member joining the arms at their lower ends, and a groove in the lower side of the passage to receive the base member of the insert, and wherein the ramp is attached to the base of the insert, whereby a bather in a bath chair may easily roll from the floor of the bathroom to the bottom of the tub.

* * * * *